US007033207B2

(12) United States Patent
Nimura

(10) Patent No.: US 7,033,207 B2
(45) Date of Patent: Apr. 25, 2006

(54) CONNECTOR

(75) Inventor: Kazuhiko Nimura, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/994,759

(22) Filed: Nov. 22, 2004

(65) Prior Publication Data

US 2005/0112935 A1 May 26, 2005

(30) Foreign Application Priority Data

Nov. 25, 2003 (JP) ..... 2003-394005

(51) Int. Cl.
*H01R 3/00* (2006.01)

(52) U.S. Cl. ..... 439/489; 439/357

(58) Field of Classification Search ..... 439/357–358, 439/489

See application file for complete search history.

(56) References Cited

U.S. PATENT DOCUMENTS 4,714,433 A * 12/1987 Rider, Jr. ..... 439/310
6,332,800 B1 * 12/2001 Kodama ..... 439/357

FOREIGN PATENT DOCUMENTS

JP 2003-45567 2/2003

* cited by examiner

*Primary Examiner*—Truc Nguyen
(74) *Attorney, Agent, or Firm*—Gerald E. Hespos; Anthony J. Casella

(57) ABSTRACT

A second housing (20) is formed with an oscillating portion (24) for creating an aerial vibration by the collision with a resiliently restored lock arm (13) and a resonance space (25) for causing the aerial vibration created by the oscillating portion (24) to resonate. When the lock arm (13) is resiliently restored, the aerial vibration created by the oscillating portion (24) upon the collision with the lock arm (13) resonates in the resonance space (25), and a collision sound of the lock arm (13) and the oscillating portion (24) is amplified by this resonance.

6 Claims, 6 Drawing Sheets

CONNECTOR

BACKGROUND OF THE INVENTION

1. Field of the Invention

The present invention relates to a connector.

2. Description of the Related Art

Japanese Unexamined Patent Publication No. 2003-45567 discloses a connector with first and second housings that can be connected together. The first housing has a lock arm and the second housing has a lock. The lock arm resiliently deforms and passes the lock in the process of connecting the two housings. The lock arm then returns resiliently to engage the lock when the two housings are connected properly.

The lock arm collides with the second housing during the resiliently restoration, and creates an audibly detectable snapping sound. The operator relies upon this audible snapping sound as indication of complete mating.

The resilient-restoring force of the lock arm is small. Thus, the lock arm collides with the second housing with a weak force and a soft collision sound. As a result, it is difficult for the operator to rely upon the collision sound to distinguish the connected state.

The invention was developed in view of the above problem and an object thereof is to increase the sound volume of a collision as a lock arm is resiliently restored.

SUMMARY OF THE INVENTION

The invention relates to a connector with first and second housings. The first housing has a resiliently deformable lock arm, and the second housing has a lock. The lock arm interferes with the lock and deflects as the first and second housings are connected. The lock arm then is restored resiliently to engage the lock when the housings are connected properly. Thus, the first and second housings are locked together. At least one of the first and second housings has an oscillating portion for creating an aerial vibration in response to collision with the resiliently restored lock arm. A resonance space is provided for amplifying the collision sound of the lock arm and the oscillating portion.

The resonance space preferably is exposed at an outer surface of the connector when the housings are connected with each other. Thus, the collision sound resonated from the resonance space can efficiently reach the ears of an operator and will not stay inside the connector.

The oscillating portion preferably is continuous with the lock and is displaced resiliently by the resilient restoring force of the lock arm when the lock arm is deformed by interference with the lock. Thus, the oscillating portion is restored resiliently when the lock arm is restored. The amplitude of the aerial vibration created by the collision of the lock arm and the oscillating portion is large as compared to a case where only the lock arm is restored resiliently. Accordingly, the collision sound amplified by the resonance in the resonance space becomes louder.

An enclosed space preferably is defined at a side of the oscillating portion opposite from the resonance space, and more particularly between the oscillating portion and the lock arm when the lock arm is restored resiliently. The aerial vibration created by the oscillating portion resonates both in the resonance space and in the enclosed space. Thus, the collision sound is loud.

DETAILED DESCRIPTION OF THE PREFERRED EMBODIMENTS

Figure 1:
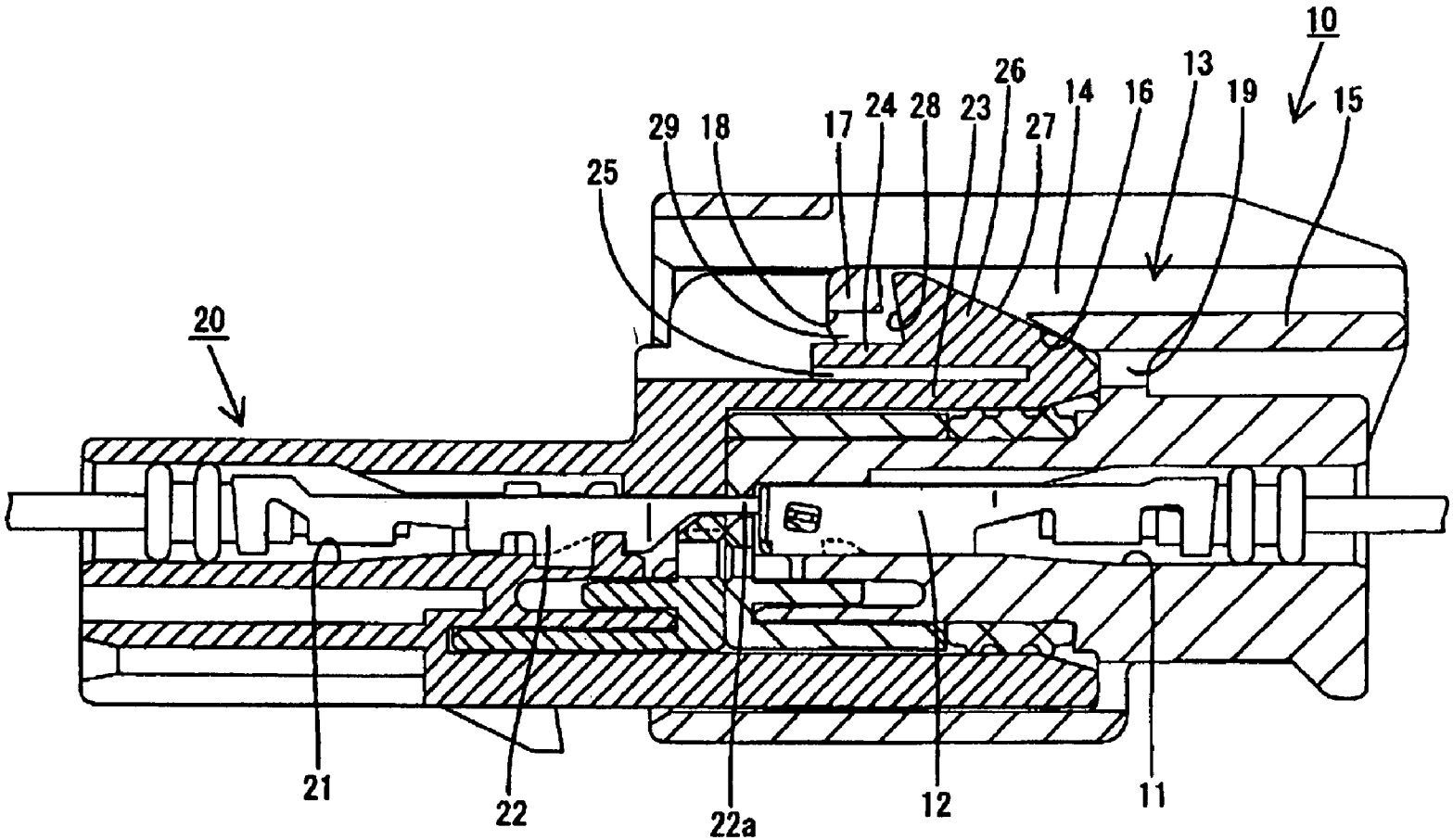
FIG. 1 is a section showing a state where a first and a second housings are connected in one embodiment of the invention.
Figure 2:
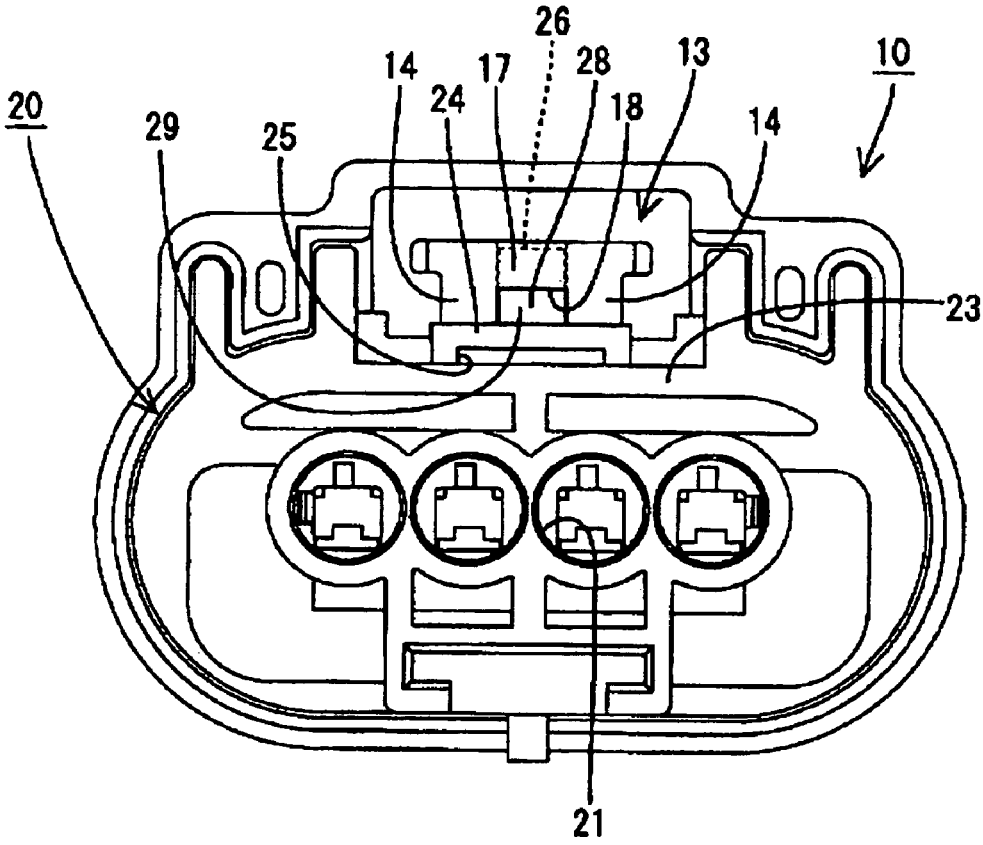
FIG. 2 is a front view of the first housing connected with the second housing.
Figure 3:
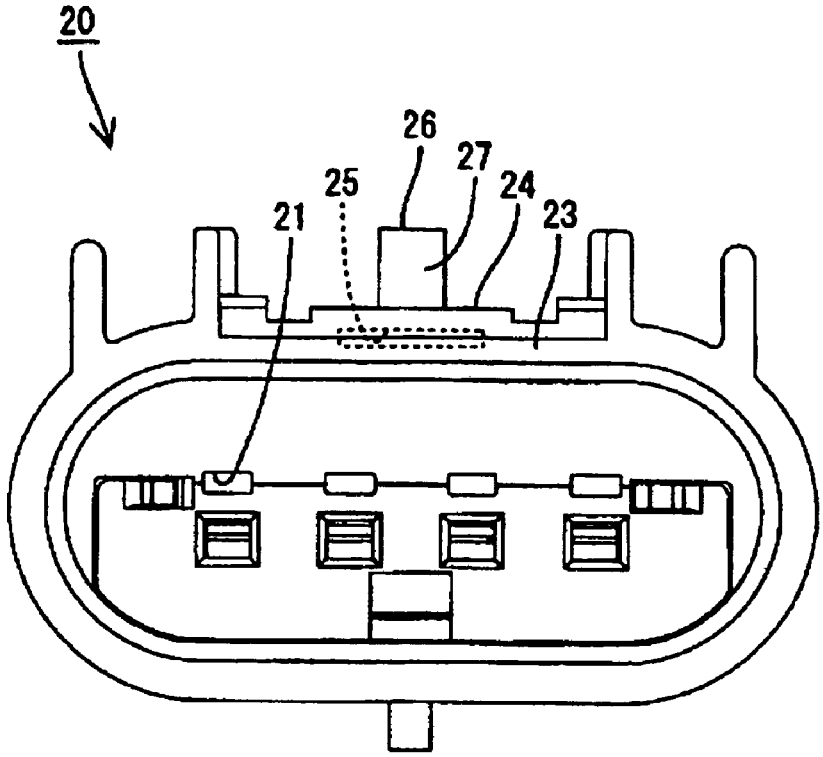
FIG. 3 is a front view of the second housing.
Figure 4:
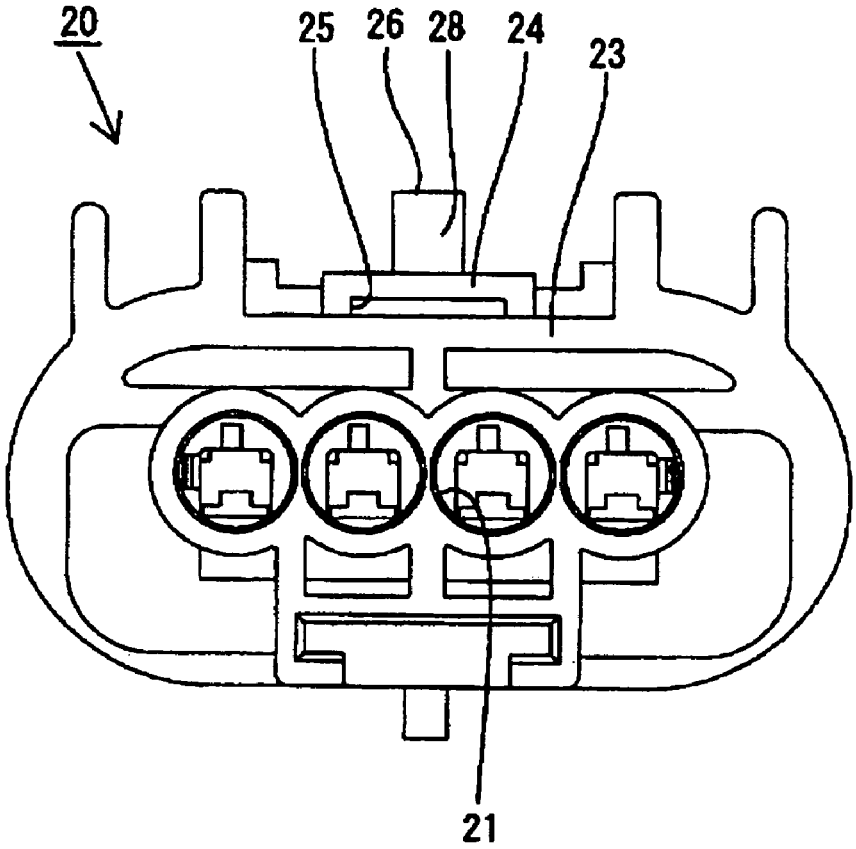
FIG. 4 is a rear view of the second housing.
Figure 5:
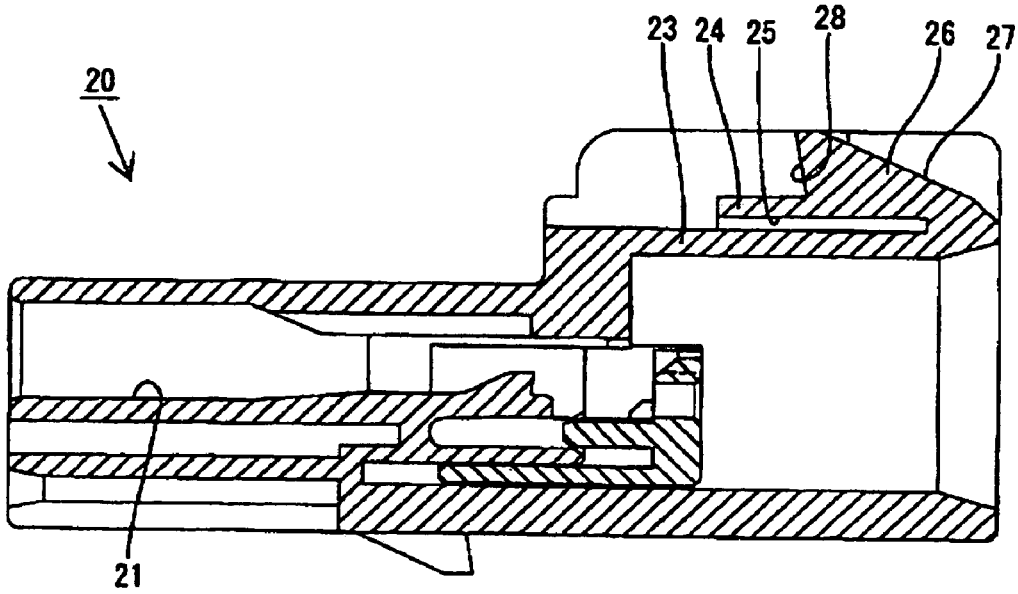
FIG. 5 is a section of the second housing.
Figure 6:
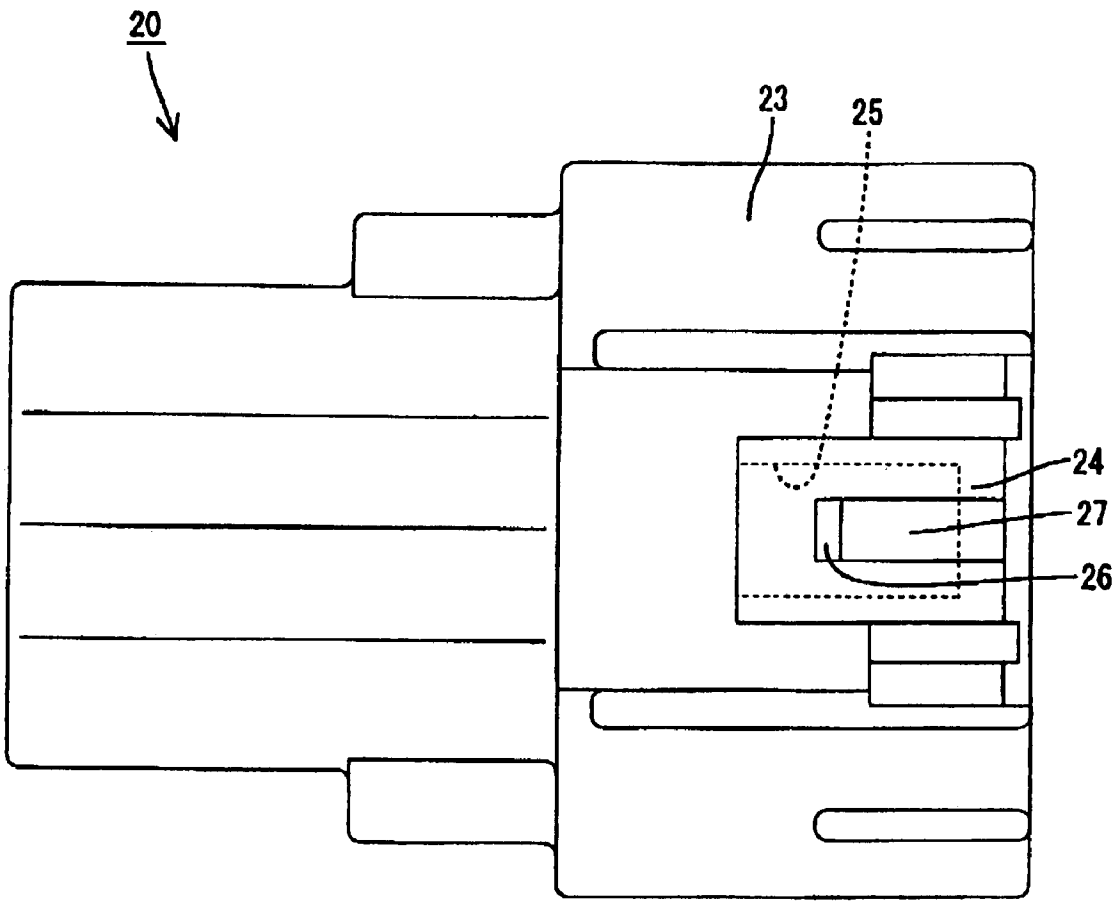
FIG. 6 is a plan view of the second housing.

A connector according to the invention includes first and second housings 10 and 20, as shown in FIGS. 1 to 6. The first housing 10 is made of a synthetic resin and is transversely symmetrical. Cavities 11 are formed transversely side-by-side and penetrate the first housing 10 in forward and backward directions, and female terminal fittings 12 are accommodated in the respective cavities 11. A lock arm 13 is formed integrally on the upper surface of the first housing 10 and extends longitudinally in forward and backward directions. The terms upper and lower are used herein to provide a convenient frame of reference, but are not intended to imply a required gravitational orientation The lock arm 13 has left and right side walls 14 and a coupling 15 that couples both sidewalls 14. The left and right sidewalls 14 are narrow and long in forward and backward directions and have a vertically long rectangular lateral cross section. The bottom edges of both sidewalls 14 are narrow and long in forward and backward directions in an area extending from the rear ends of the sidewalls 14 (right ends in FIG. 1) up to positions slightly before substantially longitudinal middles of the sidewalls 14. An overhanging slanted surface 16 is formed at the front end of the coupling 15 and slopes up to the front to face down.

An engaging portion 17 couples upper areas of the front-ends of both sidewalls 14. The front surface of the engaging portion 17 is continuous and flush with the front-end surfaces of both sidewalls 14, and the upper surface of the engaging portion 17 is continuous and flush with the upper end surfaces of both sidewalls 14. The lower surface of the engaging portion 17 is above the bottom end surfaces of both sidewalls 14. Thus, a forwardly open recess 18 is formed in the front surface and the bottom surface of the lock arm 13. Accordingly, the lock arm 13 is gate-shaped when viewed from the front.

The lower surfaces of the both sidewalls 14 are coupled to the upper surface of the first housing 10 by left and right legs 19 at a substantially longitudinal middle position of the lock arm 13 and behind the front end of the coupling 15. The lock arm 13 is supported on the upper surface of the first housing 10 by these legs 19. The sidewalls 14 are horizontal and parallel with the upper surface of the first housing 10 when the lock arm 13 is unbiased. However, the lock arm 13 can undergo a seesaw-like resilient deformation to displace the engaging portion 17 at the front end up substantially normal to a connecting direction of the housings 10, 20 with the legs 19 as supports.

The second housing 20 is made of a synthetic resin and is shaped transversely symmetrically to the first housing 10. Cavities 21 are formed transversely side-by-side and penetrate the second housing 20 in forward and backward directions. Male terminal fittings 22 are accommodated in the respective cavities 21. A receptacle 23 is formed at the front end of the second housing 20. The receptacle 23 has an open front end and a wide elliptical cross section. Tabs 22*a* at the front ends of the male terminal fittings 22 project into the receptacle 23. Part of the first housing 10 before the legs 19 fits in the receptacle 23 when the two housings 10, 20 are connected properly and a part of the lock arm 13 before the legs 19 is above the receptacle 23.

An oscillating wall 24 is formed integrally with the flat upper wall of the receptacle 23 of the second housing 20. The oscillating wall 24 is a flat and parallel with the upper surface of the upper wall, and opposite left and right side edges and the front end edge of oscillating portion 24 are coupled to the upper surface of the upper wall. A resonance space 25 is defined between the oscillating wall 24 and the upper wall of the receptacle 23. The resonance space 25 has a vertical dimension smaller than its dimensions along forward and backward directions and its transverse directions. Additionally, the resonance space 25 opens only backward with a wide slit.

The oscillating wall 24 is slightly wider than spacing between the outer surfaces of the sidewalls 14 of the lock arm 13. The front ends of the lower surfaces of the left and right sidewalls 14 of the lock arm 13 contact the rear end of the upper surface of the oscillating wall 24 or face it with a small clearance when the housings 10, 20 are connected properly, and the rear end of the upper surface of the oscillating wall 24 and the engaging portion 17 of the lock arm 13 are spaced vertically apart by the recess 18.

A lock 26 projects up at a widthwise middle of the upper surface of the oscillating wall 24. The upper surface of the lock 26 has a slanted guiding surface 27 that slopes down toward the front, and the bottom end of this slanted guiding surface 27 is continuous with the front end edge of the upper wall of the receptacle 23. The rear of the lock 26 has an overhanging locking surface 28 that inclines slightly backward with respect vertical direction (direction normal to the connecting and separating directions of the two housings 10, 20). Further, the lock 26 is sufficiently narrower than spacing between the inner side surfaces of the resonance space 25 and slightly smaller than the space between the inner surfaces of the opposite sidewalls 14 of the lock arm 13. A formation area of the lock 26 along forward and backward directions extends from the front end of the oscillating wall 24 to a position slightly behind a middle position thereof. Therefore, the lock 26 is located right above the resonance space 25.

With the two housings 10, 20 properly connected, the slanted surface 16 of the lock arm 13 faces the front end of the slanted guiding surface 27 of the lock 26 while defining a small clearance thereto. Additionally, an upper area of the locking surface 28 faces the engaging portion 17 of the lock arm 13 from behind along forward and backward directions while being spaced apart. In other words, the lock 26 is between the front end of the coupling 15 of the lock arm 13 and the engaging portion 17 of the lock arm 13 between the left and right side walls 14.

Upon connecting the two housings 10, 20, the front end of the first housing 10 fits in the receptacle 23 of the second housing 20. In the connection process, the engaging portion 17 at the front end of the lock arm 13 contacts the slanted guiding surface 27 of the lock 26. The engaging portion 17 then moves onto the lock 26 while sliding on the slanted guiding surface 27. As a result, the lock arm 13 is deformed resiliently to displace its front end up with the legs 19 as supports. A degree of the resilient deformation of the lock arm 13, i.e. a resilient restoring force, reaches its maximum immediately before the two housings 10, 20 are connected properly and when the engaging portion 17 reaches the uppermost end of the lock 26. As the lock arm 13 is deformed resiliently, the engaging portion 17 presses the lock 26 down due to the resilient restoring force of the lock arm 13. Thus, the lock 26 and the oscillating wall 24 on which the lock 26 is formed are displaced slightly down together. At this time, the oscillating wall 24 undergoes a resilient deformation and curves. Further, the front ends of the left and right sidewalls 14 of the lock arm 13 are higher than the upper surface of the oscillating wall 24.

The engaging portion 17 completely passes the lock 26 as the two housings 10, 20 become properly connected. Thus, the lock arm 13 is restored resiliently and displaces the engaging portion 17 and the front-ends of the sidewalls 14 down due to the resilient restoring force of the lock arm 13. Simultaneously, the oscillating wall 24, freed from the lock arm 13, is restored resiliently from a curved state to a flat state due to its own resilient restoring force and displaces upward. As a result, the lower surfaces of the front ends of the sidewalls 14 of the lock arm 13 (portion of the lock arm 13 most distant from the supporting point of resilient deformation) and the upper surface of the oscillating wall 24 strongly collide with each other. This collision causes the oscillating wall 24 to vibrate, thereby creating an aerial vibration. The oscillating wall 24 forms the upper wall of the resonance space 25. Thus, the vibration of the oscillating wall 24 vibrates the air in the resonance space 25, and the aerial vibration resonates in the resonance space 25. A collision sound created by the collision of the lock arm 13 and the oscillating wall 24 is amplified by this resonance and reaches the ears of an operator as a large collision sound.

An enclosed space 29 with an open back end-is defined when the lock arm 13 is restored resiliently. The enclosed space 29 is defined by the upper surface of the oscillating portion 24, the recess 18 formed by the inner surfaces of the left and right sidewalls 14 and the lower surface of the engaging portion 17 at the front end of the lock arm 13, and the locking surface 28 which is the front end surface of the lock 26. The oscillating portion 24 forms the bottom wall of this enclosed space 29. Thus, the air in the enclosed space 29 vibrates as the oscillating portion 24 vibrates and resonance also occurs in the enclosed space 29 similar to and substantially simultaneously with the resonance in the resonance space 25. The collision sound of the lock arm 13 and the oscillating portion 24 reaches the ears of the operator after being amplified by the resonance action in this enclosed space 29.

Further, with the two housings 10, 20 properly connected, the engaging portion 17 of the lock arm 13 is engaged with the locking surface 28 of the lock 26 to prevent the separation of the two housings 10, 20. As a result, the housings 10, 20 are locked in their properly connected state. The two housings 10, 20 can be separated by pressing the rear end of the lock arm 13 down to resiliently deform the lock arm 13. As a result, the engaging portion 17 moves to a position above the lock 26. In this way, the lock arm 13 and the lock 26 disengage and the two housings 10, 20 may be pulled apart.

As described above, the second housing 20 has both the oscillating wall 24 for creating an aerial vibration by collision with the resiliently restored lock arm 13 and the resonance space 25 for causing the aerial vibration of the oscillating wall 24 to resonate. The aerial vibration created by the oscillating wall 24 upon the collision with the lock arm 13 resonates in the resonance space 25 when the lock arm 13 is restored to lock the housings 10, 20 together. The collision sound of the lock arm 13 and the oscillating wall 24 is amplified by this resonance, thereby increasing the volume of the collision sound created by the resilient restoration of the lock arm 13. Therefore, the operator can judge whether the housings have been locked together based on the presence or absence of the collision sound.

The resonance space 25 is exposed backward at the outer surface of the second housing 20 when the two housings 10, 20 are connected together and no member that could block a resonance sound propagating backward from the resonance space 25 is present behind the resonance space 25. Thus, the collision sound amplified by resonance in the resonance space 25 can efficiently reach the ears of the operator without staying in the connector.

With the lock arm 13 restored, the enclosed space 29 is defined on the side of the oscillating wall 24 opposite the resonance space 25 (i.e. position located above the resonance space 25 with the oscillating portion 24 located therebetween) between the oscillating wall 24 and the lock arm 13. Thus, aerial vibration created by the oscillating wall 24 resonates both in the resonance space 25 and in the enclosed space 29 so that the collision sound is loud.

The enclosed space 29 is exposed backward similar to the resonance space 25 and no member that could block a resonance sound propagating backward from the enclosed space 29 is present behind the enclosed space 29. Thus, the collision sound amplified by the resonance in the enclosed space 29 can also efficiently reach the ears of the operator.

The oscillating wall 24 and the lock 26 are continuous with each other, and the oscillating wall 24 is resiliently displaced by receiving the resilient restoring force of the lock arm 13 after the lock arm 13 is deformed due to the interference with the lock 26. Accordingly, when the lock arm 13 is resiliently restored, the oscillating wall 24 also is also resiliently restored. Therefore, the amplitude of the aerial vibration created at the time of the collision of the lock arm 13 and the oscillating wall 24 is larger as compared to a case where only the lock arm 13 is resiliently restored, and the collision sound amplified by the resonance in the resonance space 25 becomes louder.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

The oscillating wall and the resonance space are provided only in the housing without the lock arm in the foregoing embodiment. However, they may be provided only in the housing formed with the lock arm or may be provided on both housings.

The resonance space is exposed at the outer surface of the connector with the two housings connected in the foregoing embodiment. However, the resonance space may be exposed at the inner surface of the connector according to the invention.

The resonance space is a dead-end space with only one open end in the foregoing embodiment. However, the resonance space may be a tunnel or a through hole with open ends.

The oscillating wall is displaced resiliently when the lock arm interferes with the lock in the foregoing embodiment. However, the oscillating wall may not displace when the lock arm is deformed according to the invention.

The end of the lock arm collides with the oscillating wall in the foregoing embodiment. However, a portion of the lock arm closer to the support of resilient deformation than the end may collide with the oscillating wall according to the invention.

The space at the opposite side of the resonance space is defined between the oscillating wall and the lock arm with the lock arm resiliently restored in the foregoing embodiment. However, no such space may be defined according to the invention.

What is claimed is:

1. A connector, comprising:

a first housing having a resiliently deformable lock arm; and a second housing having a front end for mating with the first housing and an opposite rear end, at least one receptacle wall extending rearward from the front end, an oscillating wall extending reward from a location in proximity to the front end of the second housing and spaced outward from the receptacle wall such that a rearwardly open resonance space is defined between the oscillating wall and the receptacle wall, a lock projecting out on the oscillating wall, the lock being configured for generating deflection of the lock arm during connection of the first and second housings and configured for locked engagement with the lock arm when the first and second housings are connected properly, the lock arm being configured for contacting the oscillating wall in response to resilient restoring forces of the lock arm when the first and second housings are connected properly, and the oscillating wall being dimensioned to vibrate in response to the contact by the lock arm, whereby the vibrations resonate through the rearwardly open resonance space to provide an audible indication of proper connection of the first and second housings.

2. The connector of claim 1, wherein the resonance space is exposed at an outer surface of the connector when the first and second housings are connected.

3. The connector of claim 1, wherein a substantially enclosed space is located rearward of the lock and at a side of the oscillating wall opposite from the resonance space and between the oscillating wall and the lock arm when the lock arm is restored resiliently.

4. The connector of claim 1, wherein a front portion of the oscillating wall and opposite side portions of the oscillating wall are connected to the receptacle wall so that the resonance space is open only at a rear end of the oscillating wall.

5. The connector of claim 1, wherein the oscillating wall is wider than the lock and wherein the lock arm is configured for contacting portions of the oscillating wall on opposite sides of said lock.

6. The connector of claim 5, wherein the lock arm is configured to be spaced from the oscillating wall at locations rearward of the lock when the first and second housings are connected properly for defining a rearwardly open substantially enclosed space rearward of the lock for enhancing resonance of vibration of the oscillating wall.

* * * * *